US005178574A

United States Patent [19]

Evoy

[11] Patent Number: 5,178,574

[45] Date of Patent: Jan. 12, 1993

[54] ARTICLE HAVING A MOVABLE FOLD MEMBER FOR ALTERATION OF A FEATURE

[76] Inventor: Ken Evoy, 68 Côte St. Charles, Hudson, Quebec, Canada, J0P 1J0

[21] Appl. No.: 777,003

[22] Filed: Oct. 16, 1991

Related U.S. Application Data

[63] Continuation-in-part of Ser. No. 532,842, Jun. 4, 1990, abandoned.

[51] Int. Cl.[5] ..... A63H 3/02

[52] U.S. Cl. ..... 446/372; 446/391

[58] Field of Search ..... 446/372, 370, 369, 320, 446/321, 391, 393, 395

[56] References Cited

U.S. PATENT DOCUMENTS

| | | | |
|---|---|---|---|
| 1,948,803 | 2/1934 | Sherrill | 446/372 |
| 2,396,654 | 3/1946 | Herrmann | 446/370 |
| 3,811,220 | 5/1974 | Glass et al. | 446/321 |
| 4,336,665 | 6/1982 | Moreau | 446/321 |
| 4,413,442 | 11/1983 | McSweeney | 446/321 |
| 4,648,851 | 3/1987 | Rosenberg | 446/372 |
| 4,776,823 | 10/1988 | Hanlon | 446/321 |

FOREIGN PATENT DOCUMENTS

| | | | |
|---|---|---|---|
| 1223735 | 7/1987 | Canada | 446/321 |

*Primary Examiner*—Mickey Yu

*Attorney, Agent, or Firm*—McFadden, Fincham, Marcus & Anissimoff

[57] ABSTRACT

An article, such as a stuffed toy, has one or more folds of material on the surface, adjacent to a feature or features, the folds being movable to alternate positions to vary the appearance of a feature. As an example, for an animal, a fold can be positioned across the head above the eyes. In an up position the eyes are fully exposed, and in a down position, partially obscured. A further fold can be positioned across the head below the nose, in a down position covering the teeth and in an up position exposing the teeth. As an additional feature, deformable members in the ears permit positioning of the ears in different ways.

7 Claims, 1 Drawing Sheet

ARTICLE HAVING A MOVABLE FOLD MEMBER FOR ALTERATION OF A FEATURE

This application is a Continuation-in-Part application of U.S. Ser. No. 07/532,842 filed Jun. 4, 1990, abandoned.

BACKGROUND OF THE INVENTION

1. Field of the Invention

This invention relates to an article having a movable fold member, and in particular relates to a stuffed animal or similar stuffed article, having one or more folds of material movable to either of at least two alternate positions, to alter one or more features.

Stuffed animals, for example, have a particular facial expression, produced by shaping, colouring and other items, but once made, the facial expression is fixed. While in some examples, the facial features, or other parts, are formed from distortable material, which can be distorted or shaped by pushing a hand into the article and using the fingers to manipulate the deformable material, such deformation disappears once the hand is removed. Thus, the particular features cannot be distorted permanently.

In the present invention an article is provided with a fold of material which can be moved from one position to another to produce a permanent alteration in a feature of the article.

2. Description of the Prior Art

Transformable toy articles of all types are known in the art. An example of such a toy is illustrated in Canadian Patent No. 1,223,735. The patent discloses a stuffed toy changeable from an initial appearance with facial features including eyes, ears, nose, mouth as well as appendages, to a second appearance in which some of the features are precluded from view and the toy has a ball form. The transformation is achieved by inverting some appendages and the facial features into an elastically expandable pocket integral with the covering of the article.

Several other stuffed toy articles are known in the art such as those in U.S. Pat. Nos. 4,336,665 and 4,413,442. The former discloses a stuffed, convertible toy having a head with two faces in opposition. The toy includes a flexible cover of material, whereby the material may selectively be pulled over to conceal one of the faces. The face concealed with the material has the appearance of a body. Although this is an interesting idea, it would not grasp the attention of a child for a prolonged period. In U.S. '442 a further transformable stuffed article is disclosed wherein the article is convertible initially from a duck to a turtle and finally to an egg. The duck has a body comprising pliant material in which there is an opening. The appendages of the duck are partially tucked into this opening, resulting in the appearance of a turtle. The turtle figure undergoes the same procedure, leaving an egg-shaped object. While this toy provides some enjoyment for children, a more stimulating toy for a child, such as the one of the present invention, allows the child greater interaction with the toy, thereby creating and retaining the child's attention.

Prior art devices for amusement, especially those intended for children, are limited in view of this invention. Although transformable toys are known in the art, a major drawback is associated with the functioning of such devices. Often, in transformable toys, only a single feature of the toy can be altered which clearly impedes a child's creative flexibility, leading to a disinterest with the toy.

It is an object of this invention to provide a device for amusement having transformable features.

In a further object of the present invention, there is provided an article having a predetermined shape or form, and having at least one closed fold of material movable from one position to another to vary the appearance of a feature of the article.

The invention is particularly applicable to stuffed toys, such as animals, having an outer covering of soft material, with a fold of the material positioned adjacent to a particular feature.

It is a further object of the present invention to provide a stuffed toy having an outer covering of flexible material has at least one fold of material positioned adjacent to a particular feature, the fold movable to alternate positions to alter the appearance of the feature.

A still further object of the present invention is to provide a toy having an outer covering and identifiable features on the outer covering, and a closed fold of material on the covering adjacent to one of the features, the fold comprising a length of the material folded about a peripherally extending fold line and joined at a line spaced from the fold line by a line of stitching, the line of stitching defining a pivot line on the outer covering and the fold of material movable about the pivot line between one position exposing the feature and another position at least partially obscuring the feature.

SUMMARY

The outer covering of the toy article is composed of a plush fabric. Above the eyes of the article, a portion of the flexible material is fixedly secured such that movement of the material is possible. The mouth area has a non-plush flexible portion of material secured to the nose of the toy.

In one possible transformation of the toy, the flexible material segment above the eyes of the toy may be foldably moved from a first position in which the eyes of the toy are completely exposed, i.e., uncovered to a position where the eyes are slightly covered. Alternatively, the material may be moved to a fully downward position, in which the facial expression of the toy is angry, i.e. "a knitted brow". A further possible expression is attainable by moving the material between the above-mentioned configurations. In another possible configuration, the material may be moved on one side only where a portion of a single eye is slightly covered. The configurations possible are diverse and allow a child to exercise his or her creativity without limitation.

In the construction of the toy animal, the facial characteristics, such as the teeth and mouth, can be provided in a suitable conventional manner, such as by having a mouth defined by one type of material with an inset of a contrasting material or colour to define, e.g., the teeth. The teeth may thus be outlined on a piece of cloth or the like, or on the other hand, other structures showing teeth such as a plastic insert secured to the mouth of the animal may be utilized. Likewise, the eyes can be portrayed by metal or plastic members which are added to the face and secured to the stuffing of the toy animal or to the cloth material; alternately, the eyes may be provided by drawing appropriate eye illustrations on a separate piece of cloth material or even on the same material, but where the eyes would be of a characteristic so as to stand out from the other portions of the body.

Further transformations in expression and facial features are achieved through manipulation of the flexible fold of material associated with the mouth. This material comprises a non-plush fabric and, in an unfolded position, substantially conforms to the shape of the mouth. The non-plush material of the mouth is much thinner than that material of the eyes and, as such, is adapted to be rolled back in small amounts thereby exposing progressively more and more of the teeth. A further variation in facial expression is achieved by entirely retracting the lip material, resulting in complete exposure of the teeth. In addition, one portion of the material may be moved while the other remains fixed, whereby a variety of facial expressions can be generated. The possible configurations of the lip material are numerous due to the flexibility of this material, its large area of coverage, and its conformation to the shape of the mouth.

The toy of the present invention is devoid of such obstacles. Children inherently enjoy stuffed animals, and this fact, in conjunction with variably changeable features on such a toy, provide unlimited enjoyment.

More than one fold of material can be provided, a fold adjacent to each of different features. Thus, it is another object of the present invention to provide a stuffed toy having an outer covering of flexible material, has two or more folds of the material, each positioned adjacent to a particular feature, each fold movable to alternate positions to alter the appearance of a particular feature.

As a particular example, a stuffed animal can have two folds of material, one above the eyes and one above the mouth. The fold above the eyes is movable alternatively to completely expose the eyes and to partially obscure the eyes, and the fold above the mouth is movable alternatively to cover the teeth or expose the teeth.

While conveniently applied to stuffed animals, using the cover material to form the folds, it is also possible to attach the folds as separate items to both soft stuffed articles and more rigid articles. In the case of soft stuffed articles, the folds can be of the same material as the covering material or of different material. In the case of more rigid articles, the folds can be of some convenient deformable material attached to the rigid article.

The toy animal of the present invention may also be provided with other ornamentation, such as simulated whiskers, eyelashes, etc., which can be used to enhance the entertainment value of the product for a child.

The toy product may be made of any suitable material, such as plush material or other appropriate coverings. The particular choice of material will depend on the particular type of toy product.

The invention will be readily understood by the following description of certain embodiments of the invention, in conjunction with the accompanying drawings.

DESCRIPTION OF PREFERRED EMBODIMENTS OF THE INVENTION

Figure 1:
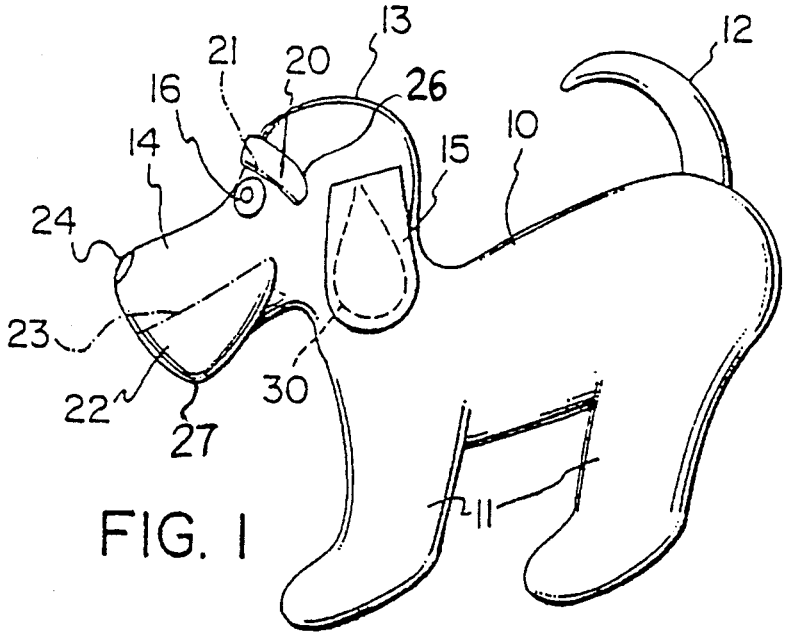
FIG. 1 is a perspective view of one embodiment of the present invention, comprising a soft stuffed animal with two folds on its head, the folds each in one position.

As illustrated in FIG. 1, a stuffed toy, in the example a dog, has the usual body 10, legs 11, tail 12, head 13 with nose and mouth portion 14, ears 15 and eyes 16. A closed fold of material 20 extends across what can be considered as the forehead, above the eyes 16. The hinge line of the fold 20 is generally indicated by the chain dotted line 21. The closed fold of material 20 comprises a length of material folded about a peripherally extending fold line generally indicated by numeral 26.

A further, lower closed fold of material 22 extends across the front of the nose and mouth portion 14, the fold 22 having a hinge line 23 some distance below the nose 24, the fold extending down over the mouth. Similar to the fold 20, fold 22 comprises a layer of material folded about a peripherally extending fold line 27.

Figure 2:
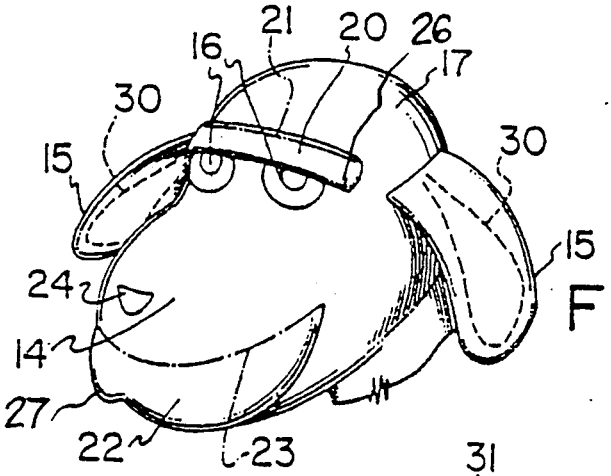
FIG. 2 is a perspective view of the head of the article in FIG. 1, with one fold moved to an alternate position.
Figure 3:
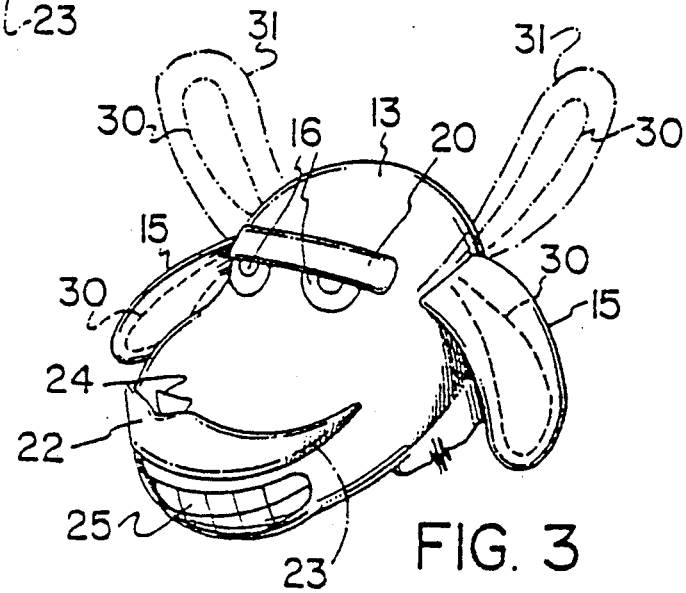
FIG. 3 is a perspective view similar to that of FIG. 2 with the other fold also in an alternate position.

In FIG. 2, the upper fold 20 has been folded down to partially cover the eyes 16. The other fold 22 is still in the downward position. Due to the flexibility of the material of the first and second folds 20 and 22, a variety of facial expressions is possible, including those in which the upper fold 20 and cover fold 22 are partially foldable between the first and second positions, and those in which only a single area of the total portion of material is movable. It is preferred that the lip member 22 comprise a resilient flexible material capable of enduring repeated folding, and that the eyebrow 20 comprise the plush material corresponding to the covering of the stuffed toy. In FIG. 3, the lower fold 22 has been folded up, along the line 23, to expose the teeth 25. The upper fold 20 is still in the down position.

The upper fold 20 can be pivoted or hinged up to its upper position, as in FIG. 1, while the lower fold 22 is in the upper position. The fold lines are normally formed by lines of stitching, which may be biased or otherwise, to provide the folds with a folding action. In addition, the folds 20 and 22 may be closed by stitching or suitable adhesives, for example.

The movements of the folds give different feature appearances. As an example, with the upper fold up and the lower fold down, a friendly appearance is obtained, while with the upper fold down and the lower fold up, a somewhat fierce appearance is obtained.

Depending upon the position of the folds, and the related feature, a variety of appearances can be obtained.

As a further feature, deformable members in the ears can be provided, to enable the ears to be positioned in a variety of ways. As indicated in dotted outline at 30, a length of relatively stiff but bendable wire can be positioned in each ear. The wire is attached at its inner end to the head 13. By bending the wire 30, the ears can be made to stand up, as indicated in dotted outline at 31 in FIG. 3.

It will be understood that although a dog has been used as an example in the description, the features of the invention can be easily employed with any stuffed article, e.g., any other animal or doll.

In an alternate embodiment of the present invention, the upper fold, i.e., the brow, may comprise two independent closed folds subsequently resulting in further possible expressions.

In yet another alternate embodiment of the present invention, the lower fold, i.e., lip member, may similarly comprise two independent folds of material.

In another embodiment, the brow member or upper fold could comprise two independent folds and be more closely associated with the eyes of the stuffed article, thereby providing foldable and movable eyelids.

Further, the movable folds, discussed herein as being associated with facial features, may equally be applied to other physical features of stuffed articles.

As those skilled in the art would realize, these preferred illustrated details and components can be subjected to substantial variation, modification, change, alteration and substitution, without affecting or modifying the function of the illustrated embodiments.

Although embodiments of the invention have been described, it is not limited thereto, and it will be apparent to persons skilled in the art that numerous modifications and variations form part of the present invention insofar as they do not depart from the spirit, nature and scope of the claims and described invention.

I claim:

1. A toy having an outer covering and identifiable features on said outer covering, and at least one closed fold of material on said covering adjacent to one of said features, said at least one fold comprising a length of said material folded about a peripherally extending fold line and joined at a line spaced from said fold line by a line of stitching, said line of stitching defining a pivot line on said outer covering and said fold of material movable about said pivot line between one position exposing said feature and another position at least partially obscuring said feature.

2. A toy as claimed in claim 1, including two folds, each separately positioned adjacent to a feature, each fold movable to vary the appearance of the related feature.

3. A toy as claimed in claim 1, comprising a stuffed toy.

4. A toy as claimed in claim 1, comprising a stuffed toy having an outer covering of soft material, said at least one fold comprising a fold of said soft material.

5. A toy as claimed in claim 4, said stuffed toy comprising a simulated animal having a head portion, and eyes and a mouth in said head portion, said at least one fold positioned across said head portion above said eyes, the fold in one position completely exposing said eyes and in another position, at least partially obscuring said eyes.

6. A toy as claimed in claim 4, said stuffed toy comprising a simulated animal having ahead portion, and eyes and a mouth in said head portion, said at least one fold positioned across said head portion above said mouth, the fold in one position covering said mouth and in another position, exposing said mouth.

7. A toy as claimed in claim 5, including ears pivotally attached to said head portion, and a deformable member in each ear, whereby on deforming said deformable members, the positions of the ears can be varied.

* * * * *